US007609142B2

(12) United States Patent
Koyama et al.

(10) Patent No.: US 7,609,142 B2
(45) Date of Patent: Oct. 27, 2009

(54) THERMISTOR

(75) Inventors: Hiroyuki Koyama, Narita (JP); Takashi Sato, Kashiwa (JP)

(73) Assignee: Tyco Electronics Raychem K.K., Kawasaki (JP)

( * ) Notice: Subject to any disclaimer, the term of this patent is extended or adjusted under 35 U.S.C. 154(b) by 0 days.

(21) Appl. No.: 10/573,146

(22) PCT Filed: Sep. 21, 2004

(86) PCT No.: PCT/EP2004/014125

§ 371 (c)(1),
(2), (4) Date: Aug. 6, 2007

(87) PCT Pub. No.: WO2005/029513

PCT Pub. Date: Mar. 31, 2005

(65) Prior Publication Data

US 2008/0068125 A1 Mar. 20, 2008

(30) Foreign Application Priority Data

Sep. 22, 2003 (JP) ..... 2003-330707

(51) Int. Cl.
*H01C 7/10* (2006.01)

(52) U.S. Cl. ..... 338/22 R; 338/309

(58) Field of Classification Search ..... 338/22 R, 338/307–309

See application file for complete search history.

(56) References Cited

U.S. PATENT DOCUMENTS

| | | | | |
|---|---|---|---|---|
| 4,251,793 | A * | 2/1981 | Vind | 338/22 R |
| 6,300,859 | B1 | 10/2001 | Myong et al. | 337/182 |
| 6,392,528 | B1 | 5/2002 | Myong | 338/22 R |
| 6,507,268 | B2 * | 1/2003 | McLoughlin | 338/21 |
| 6,559,771 | B2 * | 5/2003 | Landis | 340/603 |
| 6,794,980 | B2 * | 9/2004 | Chu et al. | 338/22 R |

FOREIGN PATENT DOCUMENTS

| | | |
|---|---|---|
| JP | 56-38617 | 4/1981 |
| JP | 09-055301 A | 2/1997 |

* cited by examiner

*Primary Examiner*—Kyung Lee

(57) ABSTRACT

A thermistor is provided with a third electrode placed so that it is not in contact with either the first or second electrode, and with a heating part integrally formed with the same material as the variable resistance part and in contact with the third electrode, the heating part changing the resistance value of the variable resistance part by generating heat when current passes between the third electrode and either of the first or second electrodes.

7 Claims, 4 Drawing Sheets

THERMISTOR

TECHNICAL FIELD

This invention relates to a thermistor that can radically reduce the current flow between electrodes at will by changing the resistance value between the electrodes through a temperature change.

Priority is claimed on Japanese Patent Application No. 2003-330707, filed Sep. 22, 2003, the content of which is incorporated herein by reference.

BACKGROUND ART OF THE INVENTION

A polymeric PTC device is a device that interrupts current flow by utilizing the positive temperature coefficient (PTC) of a conductive polymer, which decreases conductivity through thermal expansion. Polymeric PTC devices in the prior art had a construction wherein a conductive polymer is sandwiched between two electrodes; when current required to thermally expand the conductive polymer flows between the two electrodes, or when the PTC thermistor is placed under a prescribed temperature environment, it functions to radically reduce the current flow between the electrodes.

There are also constructions, based on the polymeric PTC thermistor with the above construction, where a heat source that generates heat in response to some influence is added in a heat-transferable fashion. This polymeric PTC thermistor can radically reduce the current flow between the electrodes by activating the heat source at a desired timing, and heating the conductive polymer to expand it thermally.

As prior art relative to the above, for example, in Japanese Patent Publication No. S56-38617, there is described a constant voltage device that controls voltage by utilizing heat radiation from a PTC ceramic layer 1B provided between input electrodes 2, 3 and the output electrode 6.

In the latter polymeric PTC thermistor that can interrupt current flow at a desired timing, a heat source and apparatus to activate the heat source are required in addition to the former polymeric PTC thermistor, and there was a drawback because the construction became complex and the manufacturing cost became higher. Another problem was that the module became large because there were many components.

This invention was made in view of the above circumstances and is intended to provide a thermistor that has a simple and compact construction and can be supplied inexpensively.

BRIEF DESCRIPTION OF THE INVENTION

The present invention provides a thermistor of the present invention having a variable resistance part, whose resistance value changes in accordance with changes in temperature, between a first and a second electrode, the thermistor interrupting current between the first and second electrodes in response to changes in the resistance value of the variable resistance part, including: a third electrode placed so that it is not in contact with either the first or second electrode; and a heating part integrally formed with the same material as the variable resistance part and in contact with the third electrode, the heating part changing the resistance value of the variable resistance part by generating heat when current passes between the third electrode and either of the first or second electrodes.

According to the present invention, when current equal to or above the trip current is passed between the third electrode and either of the first and second electrodes, the heating part generates heat and heats the variable resistance part. The heated variable resistance part changes the resistance depending on the change in temperature to interrupt current flow between the first and second electrodes. When the variable resistance part has a positive temperature coefficient as described above, the resistance value increases by heating so that the amount of current flow between the first and second electrodes decreases radically. When the variable resistance part has the opposite negative temperature coefficient (NTC), in other words, if it is provided with a property wherein conductivity is improved through phase transition, the resistance value decreases when heated so that current may flow between the first and second electrodes.

According to the present invention, the element that heats the variable resistance part, in other words the heating part, is formed integrally with the same material as the variable resistance part, so that there are fewer components compared with a conventional thermistor that can interrupt current flow at a desired timing, and the construction is simplified while at the same time the module is made more compact so that the manufacturing cost may be kept low. Also, since the heating part is integral with the variable resistance part and the heat from the heating part is transmitted without wasteful loss to the variable resistance part, the activating speed and accuracy (operating reliability) of the switching operation are high.

In the thermistor of the present invention, the heating part is preferably provided on both sides of the variable resistance part, or provided around the variable resistance part. By adopting such a construction, the heating of the variable resistance part by the heating part is enhanced so that the activating speed and accuracy of the switching operation are made higher.

In the thermistor of the present invention, the variable resistance part and the heating part are preferably formed integrally in sheet form, with the first electrode being provided on one surface of the section forming the variable resistance part, the second electrode being provided on the other surface, and the third electrode being provided on either of the side surfaces of the section forming the heating part. By adopting such a construction, attachment of each electrode to the integrally formed variable resistance part and the heating part is made easy and improvement in productivity may be achieved when manufacturing the thermistor.

As explained above, in the thermistor of this invention, the heating part, which is the element that heats the variable resistance part, is formed integrally with the same material as the variable resistance part, so that there are fewer components compared with a conventional thermistor that can interrupt current flow at a desired timing, and the construction is simplified while at the same time the module is made more compact so that the manufacturing cost may be kept low. Also, since the heating part is integral with the variable resistance part and the heat from the heating part is transmitted without wasteful loss to the variable resistance part, the activating speed and accuracy (operating reliability) of the switching operation may be made high.

DETAILED DESCRIPTION OF THE INVENTION

Figure 1:
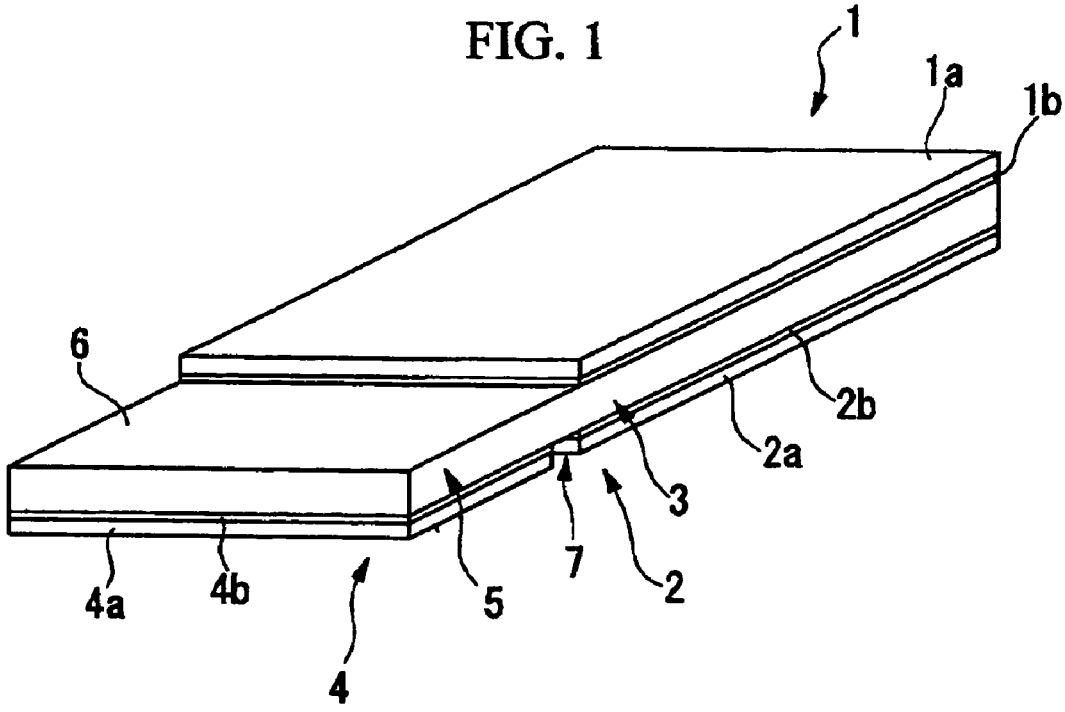
FIG. 1 is a view showing a first embodiment of this invention, with a perspective view of the polymeric PTC thermistor diagonally from above.
Figure 2:
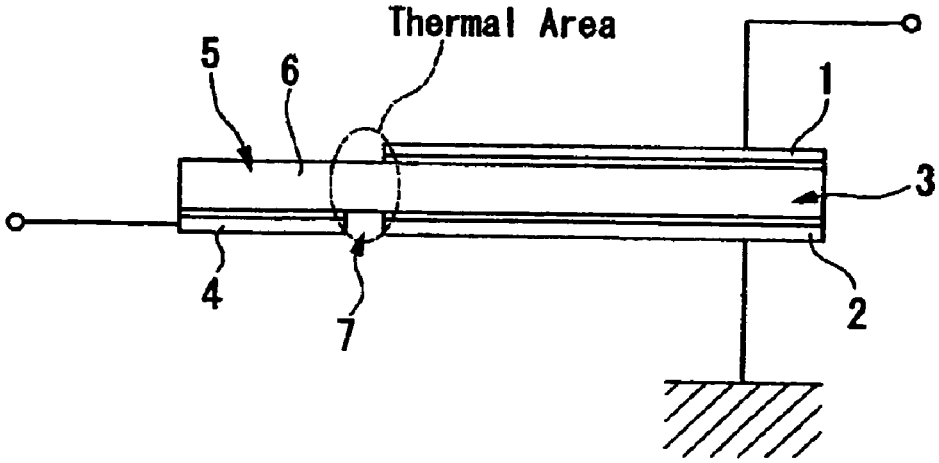
FIG. 2 is also a view showing a first embodiment of this invention, with a cross-sectional view of the polymeric PTC thermistor from the side.

The first embodiment of this invention, shown in FIGS. 1 and 2, is described. In FIG. 1 and FIG. 2, the polymeric PTC thermistor as an overcurrent protection device is shown. This polymeric PTC thermistor is provided with: two electrodes (first and second electrodes) 1, 2; a variable resistance part 3 that is sandwiched by these two electrodes 1, 2 and which changes its resistance value depending on a change in temperature; an electrode (third electrode) 4 provided so that it is not in contact with either of the electrodes 1, 2; and a heating part 5 that is formed integrally with the same material as the variable resistance part 3, which is in contact with the electrode 4, and which generates heat when current equal to or above the trip current is passed between the electrode 4 and the electrode 2 to change the resistance value of the variable resistance part 3. The variable resistance part 3 and the heating part 5 correspond to two non-overlapping sections of a conductive polymer 6 formed as a sheet.

The conductive polymer 6, from a plane view, is a rectangular sheet with a uniform thickness, and is a polymeric resin material made by kneading for example polyethylene and carbon black, then crosslinking by irradiation. Within the conductive polymer 6, carbon black particles are present linked to one another in a room temperature environment so that good conductivity is exhibited. When there is an overcurrent flowing through the conductive paths, the conductive polymer 6 thermally expands so that the distance between the carbon black particles is extended to cut the conductive paths, and the resistance increases sharply. This is the positive temperature coefficient (PTC) mentioned above.

The electrode 1 is provided on one surface (the upper surface side in FIG. 1) of the section on the conductive polymer 6 forming the variable resistance part 3. The electrode 2 is provided on the other surface (the lower surface side in FIG. 1) forming the variable resistance part 3. The electrode 1 comprises a rectangular metal piece 1*a* and nickel foil 1*b* or the like sandwiched by the metal piece 1*a* and the conductive polymer 6. The electrode 2 also has the same construction and shape as the electrode 1, and comprises a rectangular metal piece 2*a* cut aligned to the side edge of the conductive polymer 6 and nickel foil 2*b* or the like sandwiched by the metal piece 2*a* and the conductive polymer 6.

The electrode 4 is provided on the other surface of the section of the conductive polymer forming the heating part 5. The electrode 4 also has the same construction and shape as the electrodes 1, 2, and comprises a rectangular metal piece 4*a* cut aligned to the side edge of the conductive polymer 6 and nickel foil 4*b* or the like sandwiched by the metal piece 4*a* and the conductive polymer 6. A parallel gap 7 is provided between the electrode 2 and the electrode 4; the other surface of the conductive polymer 6 is exposed from this gap 7.

The polymeric PTC thermistor with the above construction uses the positive temperature coefficient of the conductive polymer 6 to function as a switch to trigger current flow between the electrodes 2, 4. The polymeric PTC thermistor is incorporated into part of a main circuit in an electrical product; if current passing through the electrodes 2, 4 is equal to or below the prescribed size, thermal expansion is not so much as to cause a trip, but the thermistor is so constructed that it is heated and thermally expands when trigger current flowing between the electrodes 2, 4 causes a prescribed section (thermal area described below) to generate heat.

In the polymeric PTC thermistor with the above construction, current flow between the electrodes 1, 2 is maintained without any hindrance as long as a hold current of a size prescribed by the main circuit is flowing. However, if an excessively large current compared with the hold current does not flow in the main circuit during an abnormality, or the amount of current flow in the main circuit is reduced radically on a discretionary basis, the conductive polymer 6 between the electrodes 2, 4 expands thermally when a trigger current flows, thereby increasing the resistance value and generating heat. The heating part 5 does not generate heat as a whole, but the section adjoining the variable resistance part 3 wherein the conductive polymer 6 is exposed through the formation of the gap 7 (thermal area in FIG. 2) generates heat locally. When the heating part 5 generates heat, the variable resistance part 3 formed integrally is heated and thermally expands, causing the internal conductive paths to be cut and the resistance to increase substantially, so that the amount of current flow between the electrodes 1, 2 is decreased radically.

According to the polymeric PTC thermistor with the above construction, the variable resistance part 3 and the heating part 5 that heats it are formed integrally by a single sheet of conductive polymer 6, so that there are fewer components compared with a conventional thermistor that adds a separate heat source, and the construction is simplified while at the same time the module is made more compact so that the manufacturing cost may be kept low. Also, since heat from the heating part is transmitted without wasteful loss to the variable resistance part, the activating speed and accuracy of the switching operation are high.

Further, by adopting a construction wherein the variable resistance part 3 and the heating part 5 are formed integrally in sheet form, with the first electrode being provided on one surface of the section forming the variable resistance part 3, the second electrode being provided on the other surface, and the third electrode being provided on either of the side surfaces of the section forming the heating part 5, attachment of each electrode to the integrally formed variable resistance part 3 and the heating part 5 is made easy and improvement in productivity may be achieved when manufacturing the polymeric PTC thermistor.

In this embodiment, an explanation on the thermistor of this invention was for a polymeric PTC thermistor, in other words a device utilizing the positive temperature coefficient of the conductive polymer 6 to radically decrease the amount of current flow between the electrodes 1, 2. However, the thermistor of this invention may also be applicable to a so-called NTC thermistor, in which a member (ceramic semiconductor and the like) provided with a negative temperature coefficient is used in the part corresponding to the conductive polymer 6 to allow current to flow between the electrodes 1, 2, where the amount of current flow is radically reduced.

Figure 3:
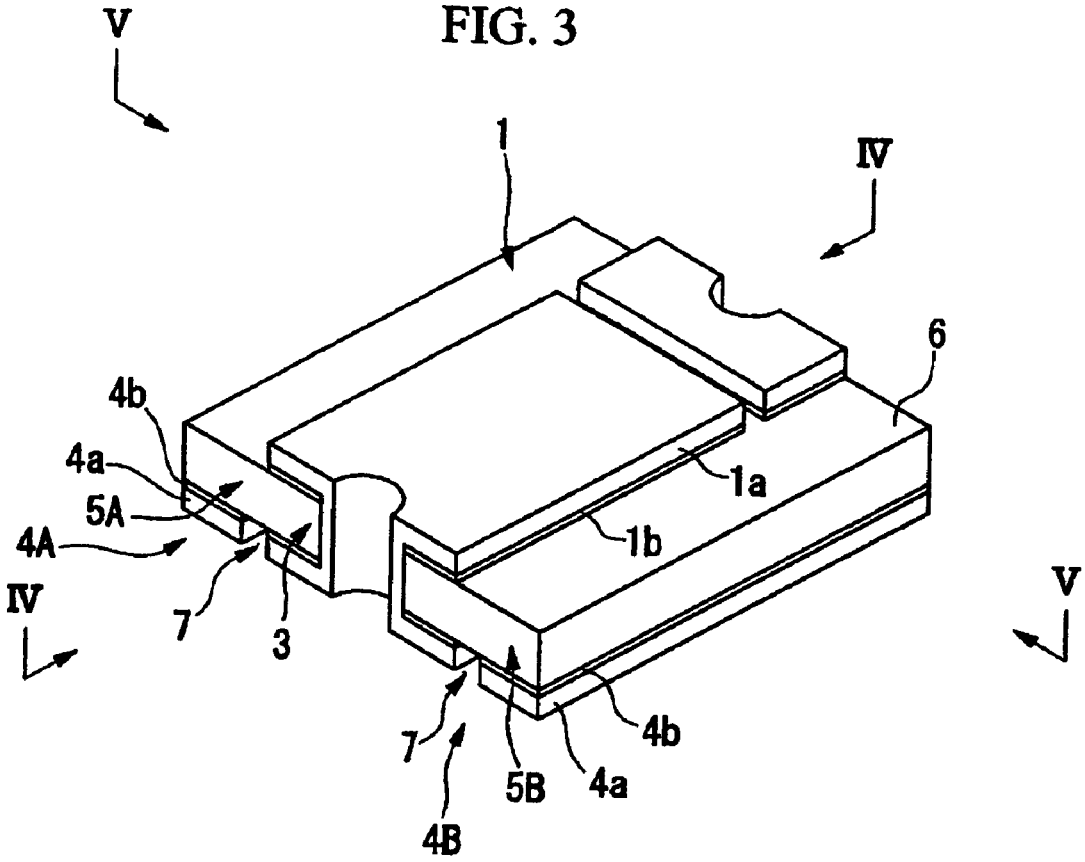
FIG. 3 is a view showing a second embodiment of this invention, with a perspective view of the polymeric PTC thermistor diagonally from above.
Figure 4:
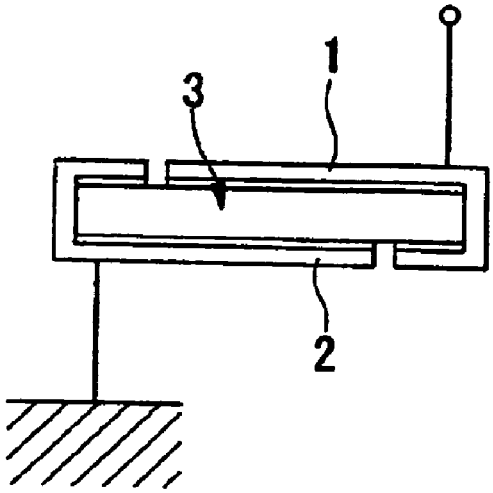
FIG. 4 is also a view showing a second embodiment of this invention, with a cross-sectional view of the polymeric PTC thermistor along the line IV-IV in FIG. 3.
Figure 5:
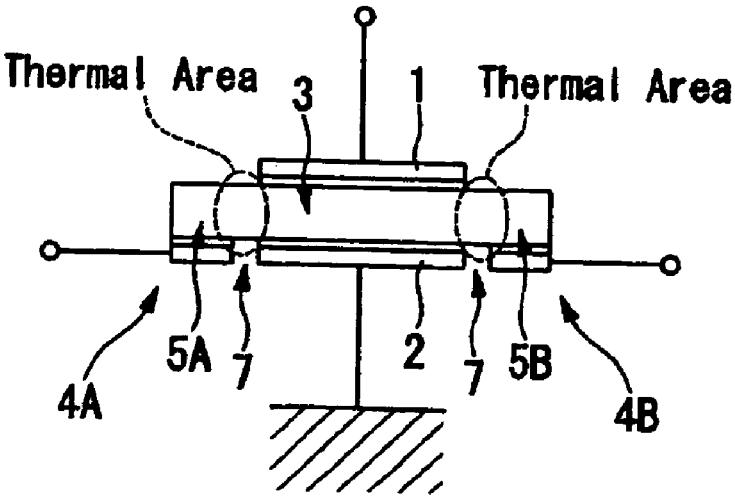
FIG. 5 is also a view showing a second embodiment of this invention, with a cross-sectional view of the polymeric PTC thermistor along the line V-V in FIG. 3.

Next a second embodiment of this invention, shown in FIGS. 3 through 5, is explained. The structural components already explained in the above embodiment will have the same legends and explanations will be omitted.

In FIG. 3 through FIG. 5, in the same way as in the first embodiment, a polymeric PTC thermistor is shown. This polymeric PTC thermistor is, in the same way as in the first embodiment, provided with a rectangular sheet-form conductive polymer 6. In this embodiment, the variable resistance part 3 is placed in the center, with two heating parts 5A, 5B provided on both sides thereof, and electrodes 4A, 4B are attached to the heating parts 5A, 5B respectively as the third electrode.

The electrode 1 is placed for the greater part on one surface (upper surface side in FIG. 3) of the center section, forming the variable resistance part 3, of the conductive polymer 6, while a portion is wrapped over the edge and placed on the other surface. The electrode 2 is placed for the greater part on the other surface (lower surface side in FIG. 3) of the center section, forming the variable resistance part 3, of the conductive polymer 6, while a portion is wrapped over the edge and placed on the one surface.

The electrode 1 is placed for the greater part on one surface (upper surface side in FIG. 3) of the center section, forming the variable resistance part 3, of the conductive polymer 6, while a portion is wrapped over and placed on the other surface. The electrode 2 is placed for the greater part on the other surface (lower surface side in FIG. 3) of the center section, forming the variable resistance part 3, of the conductive polymer 6, while a portion is wrapped over and placed on one surface.

The electrode 4A is placed on the other surface of the section, forming one heating part 5A (left side edge in FIG. 3), of the conductive polymer, and the electrode 4B is placed on the other surface of the section, forming the other heating part 5B (right side edge in FIG. 3), of the conductive polymer. Between the electrode 2 and the electrodes 4A, 4B are provided parallel gaps 7, through which the other surface of the conductive polymer 6 is exposed.

In the polymeric PTC thermistor with the above construction, the momentum for activation is the same as in the first embodiment. However, according to the polymeric PTC thermistor with the above construction, the heating parts 5A, 5B are provided on both sides of the variable resistance part 3 and heating of the variable resistance part 3 is enhanced because it is heated simultaneously from both sides so that the activating speed and accuracy of the switching operation are made higher. Also, if a trigger current is not applied in the regular way to either of the heating parts, the variable resistance part may be heated by the other heating part with the current applied in the regular way, so that the amount of current flow will decrease without malfunctioning, and the reliability of activation is enhanced.

Figure 6:
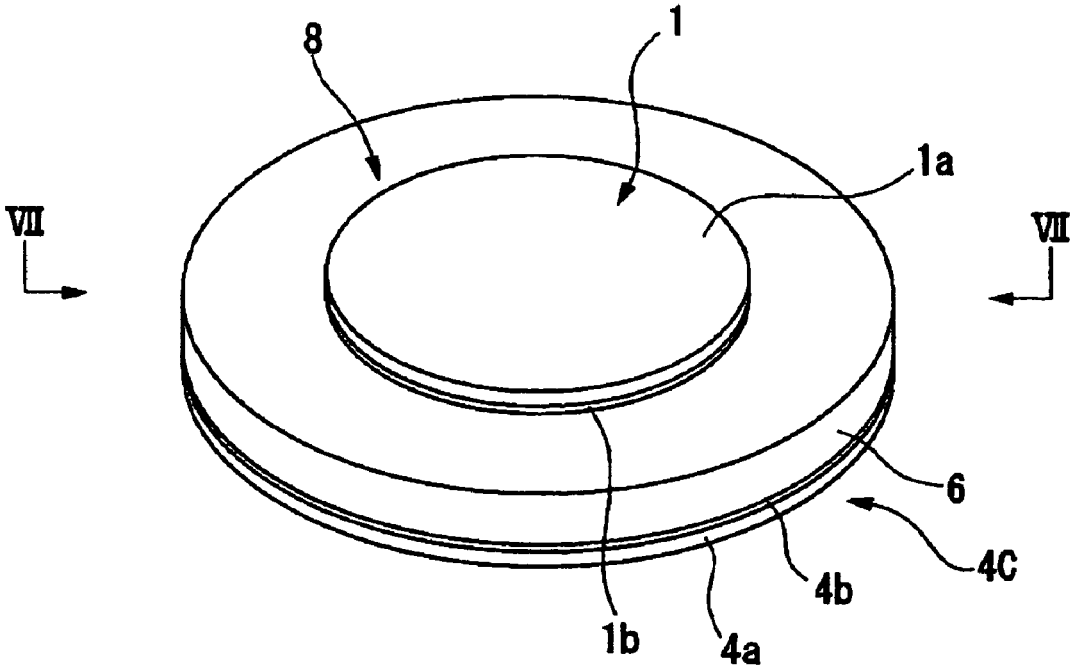
FIG. 6 is a view showing a third embodiment of this invention, with a perspective view of the polymeric PTC thermistor diagonally from above.
Figure 7:
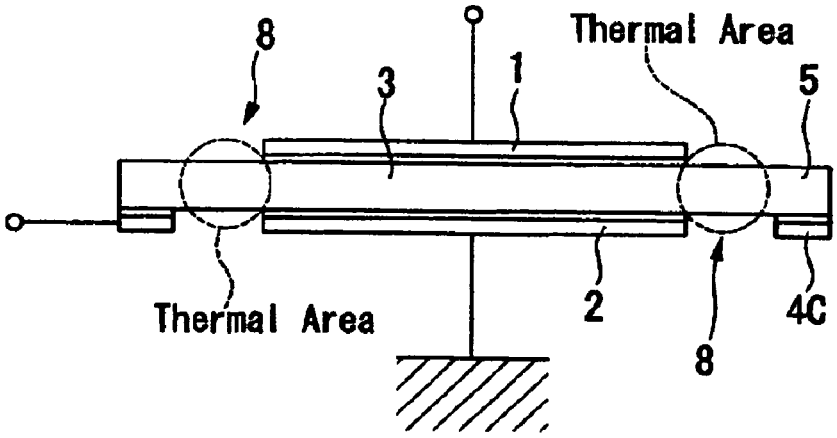
FIG. 7 is also a view showing a third embodiment of this invention, with a cross-sectional view of the polymeric PTC thermistor along the line VII-VII in FIG. 6.

Next a third embodiment of this invention, shown in FIGS. 6 and 7, is explained. The structural components already explained in the above embodiment will have the same legends and explanations will be omitted.

In FIG. 6 and FIG. 7, in the same way as in the first embodiment, a polymeric PTC thermistor is shown. Unlike each of the embodiments above, this polymeric PTC thermistor is provided with a round sheet-form conductive polymer 6; the variable resistance part 3 is placed in the center, with the heating part 5C provided surrounding its periphery. The electrode 4C, as the third electrode, is provided on one surface of the heating part 5C.

The electrode 1 is provided on one surface (the upper surface side in FIG. 6) of the center section on the conductive polymer 6 forming the variable resistance part 3. The electrode 2 is provided on the other surface (the lower surface side in FIG. 6) forming the variable resistance part 3. The electrode 4C is provided on the other surface of the peripheral section of the conductive polymer 6 forming the heating part 5C. Between electrode 2 and the electrode 4 is provided an annular gap 8, from which the other surface of the conductive polymer 6 is exposed.

In the polymeric PTC thermistor with the above construction also, the momentum for activation is the same as in the first embodiment. However, according to the polymeric PTC thermistor with the above construction, the heating part 5C is provided surrounding the variable resistance part 3 and heating of the variable resistance part 3 is enhanced because it is heated from all sides so that the activating speed and accuracy of the switching operation are made higher.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

The present invention relates to a thermistor having a variable resistance part, whose resistance value changes in accordance with changes in temperature, between a first and a second electrode, the thermistor interrupting current between the first and second electrodes in response to changes in the resistance value of the variable resistance part, including: a third electrode placed so that it is not in contact with either the first or second electrode; and a heating part integrally formed with the same material as the variable resistance part and in contact with the third electrode, the heating part changing the resistance value of the variable resistance part by generating heat when current passes between the third electrode and either of the first or second electrodes. According to the thermistor of the present invention, the heating part, which is the element that heats the variable resistance part, is formed integrally with the same material as the variable resistance part, so that there are fewer components compared with a conventional thermistor that can interrupt current flow at a desired timing, and the construction is simplified while at the same time the module is made more compact so that the manufacturing cost may be kept low.

The invention claimed is:

1. A thermistor having a variable resistance part, whose resistance value changes in accordance with changes in temperature, between a first and a second electrode, the thermistor interrupting current between the first and second electrodes in response to changes in the resistance value of the variable resistance part, comprising:

a third electrode placed so that it is not in contact with either the first or second electrode and does not overlap either the first or second electrode; and a heating part integrally formed with the same material as the variable resistance part in the form of a sheet, the heating part and the variable resistance part forming a non-overlapping section of the sheet, the heating part being in contact with the third electrode, the heating part changing the resistance value of the variable resistance part by generating heat when current passes between the third electrode and either of the first or second electrodes.

2. A thermistor according to claim 1, wherein the heating part is provided on both sides of the variable resistance part.

3. A thermistor according to claim 2 wherein:

the first electrode is positioned on one side surface of a section comprising the variable resistance part, and the second electrode is positioned on the other side surface; and the third electrode is positioned on either side surface of the section comprising the heating part.

4. A thermistor according to claim 1, wherein the heating part is provided surrounding the variable resistance part.

5. A thermistor according to claim 4 wherein:

the first electrode is positioned on one side surface of a section comprising the variable resistance part, and the second electrode is positioned on the other side surface; and the third electrode is positioned on either side surface of the section comprising the heating part.

6. A thermistor according to claim 1, wherein:

the first electrode is positioned on one side surface of a section comprising the variable resistance part, and the second electrode is positioned on the other side surface; and the third electrode is positioned on either side surface of the section comprising the heating part.

7. A thermistor according to claim 1 wherein the variable resistance part comprises a conductive polymer composition.

* * * * *